US007913350B2

(12) United States Patent
Boecking

(10) Patent No.: US 7,913,350 B2
(45) Date of Patent: Mar. 29, 2011

(54) DEVICE FOR SETTING A BRUSH ONTO A ROLL

(75) Inventor: Reinhard Boecking, Kreuztal (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 737 days.

(21) Appl. No.: 11/989,189

(22) PCT Filed: Aug. 1, 2007

(86) PCT No.: PCT/EP2007/006811

§ 371 (c)(1),
(2), (4) Date: Jan. 22, 2008

(87) PCT Pub. No.: WO2008/017412

PCT Pub. Date: Feb. 14, 2008

(65) Prior Publication Data

US 2010/0125993 A1 May 27, 2010

(30) Foreign Application Priority Data

Aug. 5, 2006 (DE) ..... 10 2006 036 710

(51) Int. Cl.
*A46B 15/00* (2006.01)

(52) U.S. Cl. ..... 15/256.51; 15/256.52

(58) Field of Classification Search ..... 15/256.5, 15/256.51, 256.52, 256.53; 101/425, 169; 118/126, 261, 652
See application file for complete search history.

(56) References Cited

U.S. PATENT DOCUMENTS

| | | | | | |
|---|---|---|---|---|---|
| 3,309,993 | A | * | 3/1967 | Grembecki et al. | 101/425 |
| 3,603,125 | A | * | 9/1971 | Edwards | 72/12.5 |
| 4,015,307 | A | * | 4/1977 | Kossak | 15/256.52 |
| 5,035,178 | A | * | 7/1991 | Jahn et al. | 101/425 |
| 5,086,701 | A | * | 2/1992 | Gasparrini et al. | 101/425 |
| 5,531,090 | A | * | 7/1996 | Klein et al. | 72/236 |
| 6,513,432 | B1 | * | 2/2003 | Richter | 101/425 |
| 6,691,617 | B2 | * | 2/2004 | Emery et al. | 101/424 |

FOREIGN PATENT DOCUMENTS

| | | | |
|---|---|---|---|
| GB | 0310150 | * | 4/1929 |
| GB | 1270314 | * | 4/1972 |
| JP | 2104408 | * | 4/1990 |

* cited by examiner

*Primary Examiner* — Dung Van Nguyen
(74) *Attorney, Agent, or Firm* — Abelman, Frayne & Schwab

(57) ABSTRACT

The invention relates to a device for placing a brush (1) against rollers (2), for example in roll stands, in particular against the working and/or support roller of a roll stand for the hot rolling of aluminium, wherein the brush (1) is mounted on a pivot lever and can be placed in contact against the roller (2) by means of a placement device (3) which exerts a placement force. It is provided here according to the invention that the placement device (3) for the brush (1) comprises at least one adjusting element (5) which is arranged so as to be rotatable with respect to the pivot lever (12) and which is operatively connected to the pivot lever by means of a force transmission element (4). A regulating circuit (6) is designed to regulate the placement force to be constant, proceeding from a nominal force $F_0$, in such a way that, by means of a monitoring device (7) for the rotational angle of the adjusting element (5) with respect to the pivot lever, the placement force can be regulated to be constant by means of at least one actuating element (8).

12 Claims, 2 Drawing Sheets

DEVICE FOR SETTING A BRUSH ONTO A ROLL

Figure 1:
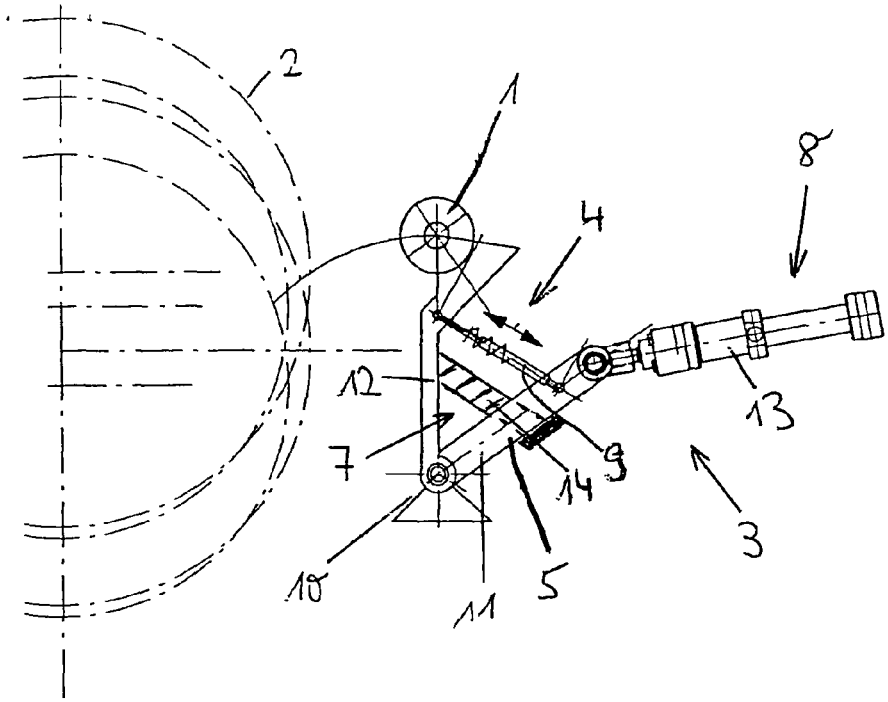

The invention relates to a device for setting a brush on to a roll, for example in rolling stands or strip guiding devices, in particular on to the working and/or supporting roll of a rolling stand for hot rolling aluminum, according to the preamble of patent claim 1.

In principle, in devices for setting a brush on to rolls in rolling stands, there is a need to be able to set a substantially constant setting force irrespective of the rolls or roll diameters used and their working positions, and also independently of the wear of the brushes. To this end, the prior art discloses, firstly, such embodiments of devices for setting a brush on to rolls or rollers in rolling stands in which automatic correction of the prior wear is omitted. Secondly, such embodiments are known in which, for example, manual adjustment of a stop is carried out. In this case, the last-named embodiments have the disadvantage in particular that manual setting of stops is not suitable for the setting of a substantially constant setting force in the case of different roll or roller diameters and their working positions. Furthermore, the prior art also discloses such embodiments in which a cylinder is used in order to reach the working position, as well as an additional pneumatic cylinder which, via pressure control, is intended to produce a constant setting force. In this case, solutions of this type require an additional medium, low-friction seals, etc. In this regard, reference is made to the following documents in relation to the prior art:

EP 0 0605 833 B1 discloses a device for setting a brush roll, in particular on to the working roll of a rolling stand for hot rolling aluminum, in which the brush roll can be rotated toward the working roll position and can be displaced translationally parallel to the working roll and is mounted on both sides in pivotable mountings. The pivoting bearing of each brush roll holder is in this case arranged on the working roll chock and, furthermore, the holder has a pivoting lever which is located between a controllable actuating element and a restoring supporting element, the actuating element being arranged in the counterbalancing block or bending block of the working rolls, and the supporting element being arranged on the working roll chock. In this case, in one embodiment, provision is made for the actuating element to be a hydraulic double-acting piston-cylinder unit, whose piston shaft bears on the pivoting lever. Furthermore, provision is made for the supporting element to comprise a supporting rod on the pivoting lever and a supporting cylinder, it being possible for the supporting rod to dip into the supporting cylinder counter to a spring arrangement, and the supporting cylinder being pivotably arranged (bearing block) on the working roll chock. Provision can be made in this case for the actuating element for the pivoting lever to be arranged in the counterbalancing block of the working rolls, provided with at least one hydraulic cylinder; in another embodiment, provision is made for the actuating element for the pivoting lever to be arranged in the fixed or displaceable bending block for the working rolls, provided with at least one hydraulic cylinder. The intention with a device constructed in this way for setting a brush roll is for the brush setting systems previously employed to be improved, to be specific, in particular on rolling stands where the installation and conversion conditions are extremely limited.

With the pivotable brush holder described here, the intention is in particular to achieve the advantage that there is no relative movement in the vertical plane between the brush holder and the chock. There is also to be no relative movement between the holder, the actuating element and the supporting element. As compared with the previously known solutions, there is also to be no change in the lever relationships and, consequently, no change in the pressing forces of the brush roll on to the working roll either in the event that the entry to the stand is changed. Furthermore, an extremely space-saving construction is achieved, which may be integrated into existing constructional elements of the rolling stand. In the event of a working roll change, no complicated mounting or dismantling measures or additional adjustments should be required. The action of the embodiment described is such that, in a setting position for the brush roll, this brush roll and the working roll are preset to a minimum distance. Surface contact between the two parts can be effected by actuating the piston-cylinder unit. For this purpose, a hydraulic pressure medium is forced into the cylinder chamber of this actuating element, by which means the piston and the piston shaft are lowered downward in the direction of the roll chock. Consequently, the head of the piston rod forces the pivoting lever of the holder on the contact surface downward counter to the spring force of the supporting element, which means that the brush roll is moved toward the working roll until it bears on the latter. If the piston-cylinder unit is depressurized hydraulically, the piston shaft of this unit moves upward and the spring-loaded supporting rod moves upward to the same extent and acts on the pivoting lever in such a way that the mounting of the brush roll and therefore the brush roll itself pivots away downward about the pivoting bearing until a predefined distance between the two rolls is produced. This distance is predefined adjustably by means of appropriate setting of a limiting element on the supporting rod.

German laid-open specification DE-OS 21 50 781 relates to a setting device for a rotating brush for cleaning the working rolls of a quarto stand. In this case, provision is made for the bearings of the brushes to be fixed to rings, which are rotatably mounted on the bearing covers on the roll side of the supporting roll chocks. In one embodiment, the rings are provided with external toothing, in which a drive pinion engages on the side facing away from the working roll. Provision is also made for the pinion to be fixed to a shaft mounted in the chock, on which shaft, on the end emerging on the outside of the stand, an adjusting lever is arranged fixedly so as to rotate with it, on which the piston rod of a pressure medium cylinder mounted on the chock is fixed. With a setting device of this type, it is intended to be possible to keep the region between working roll bearings and supporting roll bearings free of any linkage. The brush bearings are in this case intended to be guided exactly by the rings, it being possible as mentioned for the rings to be provided with external toothing, in which a drive pinion engages on the side facing away from the working roll. In this case, as a drive of the pinion, pressure medium cylinders are fixed to the chocks, their piston rods each engaging on an adjusting lever which is anchored on the ends of the shafts emerging from the chocks on the outside. By means of pressurizing the cylinders, the bearing rings are rotated and the roll brushes are either pivoted toward the working roll or away from the latter. In order to ensure uniform setting of the roll brushes via the two cylinders, the two pinions are firmly connected to each other via a shaft so as to rotate with each other.

In these known setting devices for rotating brush rolls or the like, it is disadvantageous in particular that, in order to provide a constant setting force, a large number of parameters, such as a change in the roll or roller diameter employed and their working positions, and also wear of the brushes, has to be monitored. In this case, in the case of mechanical setting by means of cylinders, it is disadvantageous in particular that, as a result of different strokes or movements, the force directions and lever arms and therefore the resulting setting forces on the brush are changed. Thus a desired constant setting force on the brush cannot be set via the force on the cylinder.

Taking this as its starting point, the invention is based on the object of improving or further developing the known devices for setting a brush whilst maintaining the previous advantages in such a way that, with simple means, a constant setting force can be set irrespective of the roll diameters used and their working positions, and also irrespective of the wear of the brush.

According to the invention, the object is achieved in that the setting device for the brush comprises at least one adjusting element that is arranged such that it can rotate in relation to the pivoting lever, and a force transmission element for forming an operative connection between the pivoting lever and the adjusting element; a monitoring device is provided to monitor the angle of rotation of the adjusting element in relation to the pivoting lever; and a control loop is provided in order to keep the setting force of the brush against the roll constant to a predefined intended force $F_0$ by readjusting and keeping constant the angle of rotation monitored by the monitoring device, via at least one actuating element.

In this way, for the first time with simple means, a device for setting a brush is provided in which a constant setting force can be set irrespective of the roll diameters used and their working positions and also independently of the wear of the brush. In the arrangement according to the invention, only one parameter, namely the angle of rotation, advantageously still needs to be monitored in order to keep the setting force constant. In this case, conclusions about the force on the brush are drawn via the angle of rotation. The parameters that change, for example during the rolling, such as roll wear (smaller diameter), brush wear or a changed position of the rolls, have no influence on the magnitude of the setting force, since their changes are compensated automatically by the construction according to the invention. This also applies to changing diameters or working positions in the event of a roll change. Overall, with the arrangement according to the invention, very simple and functionally suitable control of the setting force is achieved by using only a few additional components; in this case, in particular, no additional components such as additional pneumatics or hydraulic control are needed. The brushes are used in particular for cleaning the rolls.

In the preferred embodiment of the present invention, the force transmission element between adjusting element and pivoting lever is formed as a compression spring. This is a constructionally simple embodiment.

According to a further refining feature of the present invention, provision is made for the adjusting element, which is arranged such that it can rotate in relation to the pivoting lever, to be constructed as an adjusting lever that is mounted such that it can rotate about the pivot axis. A construction of this type permits particularly simple registration of the angle of rotation. In this case, it is worth mounting the rotating brush device at one end of a pivoting lever whose diametrically opposite end is likewise mounted in the pivot axis.

According to a further refining feature of the present invention, it is worth forming the actuating element for the constant regulation of the setting force as a hydraulic cylinder. Via this hydraulic cylinder, constant regulation of the setting force is possible without difficulty. In this case, in a preferred refinement, provision is made for the actuating element for the constant regulation of the setting force to be formed as a hydraulic cylinder acting on the adjusting lever.

According to a further refining feature of the present invention, it is expedient for the monitoring device for the angle of rotation to be formed as a rotary encoder. By using this rotary encoder, the force change is converted in a simple way into an angle change in order to determine the current actual value for the angle of rotation.

According to a further refining feature of the present invention, it is worth forming the predefinition for the intended force $F_0$ for the control loop as a function of the brush type. In this case, provision is further made for the predefinition for the intended force $F_0$ for the control loop to be formed as a function of the roll width.

According to a further feature of the present invention, provision can optionally be made for the predefinition for the intended force $F_0$ for the control loop to be formed as a function of the roll material; furthermore, according to a last feature of the present invention, provision can optionally be made for the predefinition for the intended force $F_0$ for the control loop to be formed as a function of the strip material.

The invention is illustrated in the figures of the drawing in an exemplary embodiment.

Figure 2:
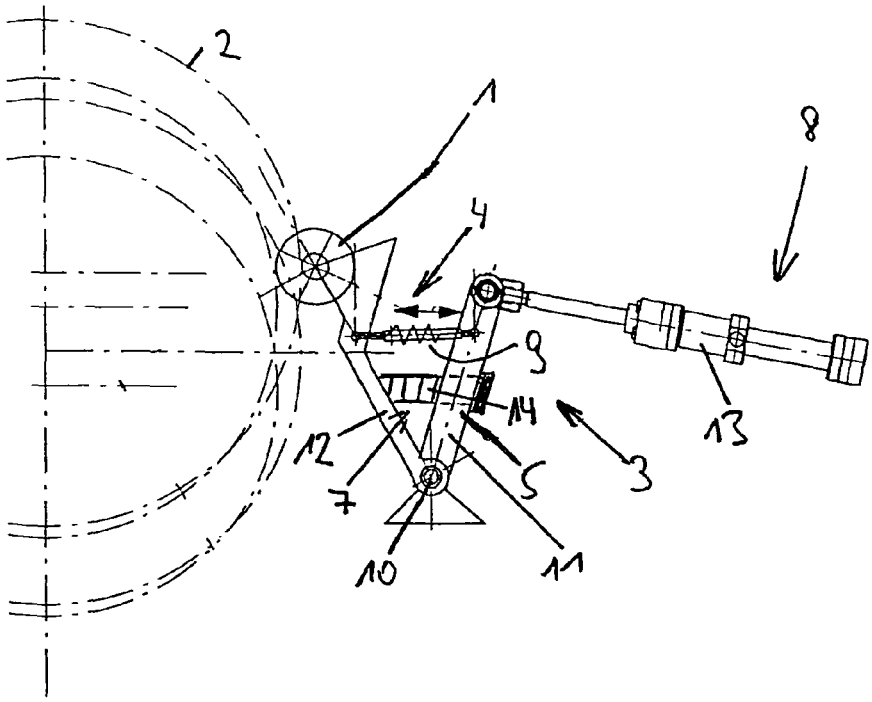
Figure 3:
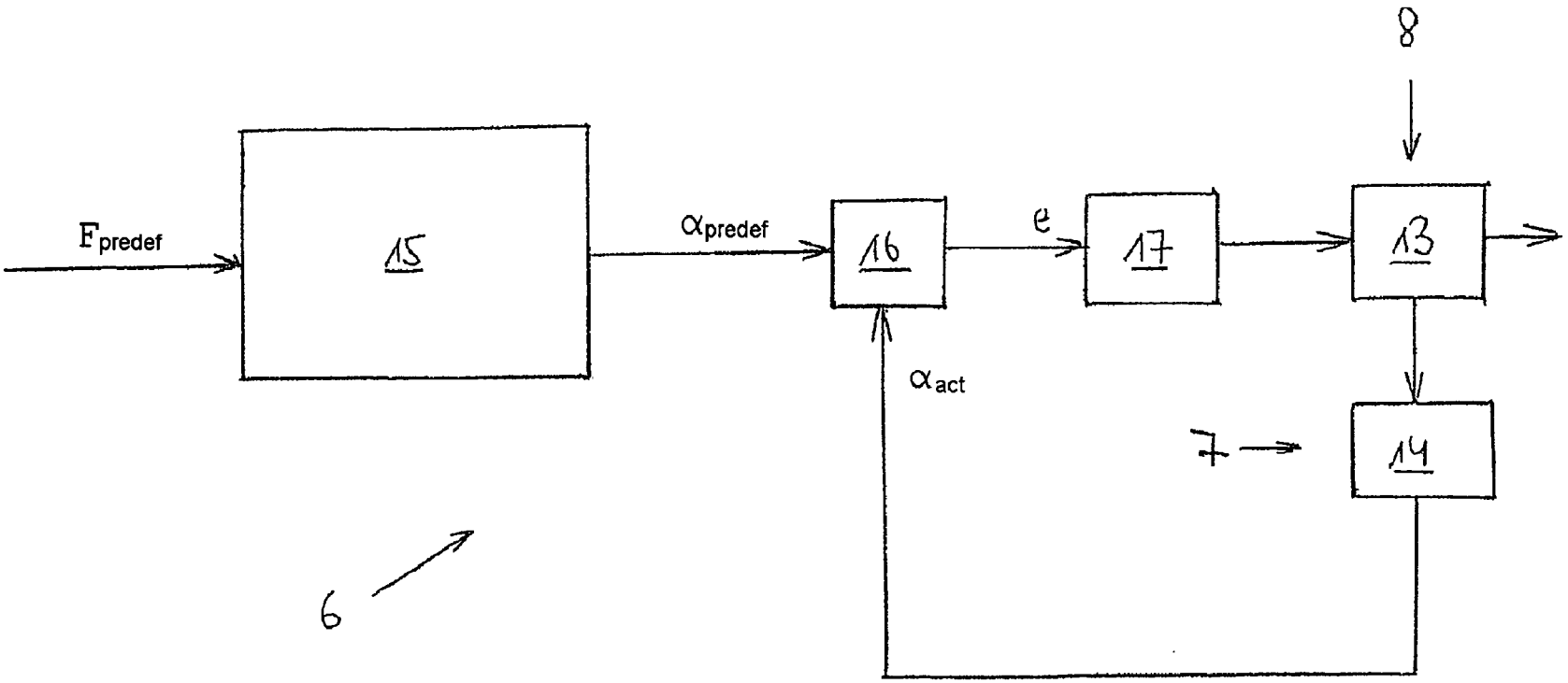

In the figures:

FIG. 1 shows a schematic side view of the device according to the invention for setting a rotating brush device with the brush device in its zero position, FIG. 2 shows the schematic side view according to FIG. 1 with the brush device in its effective position located on the roll, FIG. 3 shows a schematic illustration of the control loop of the device according to the invention for setting a brush.

The device according to the invention for setting a preferably rotating brush, designated generally by 1, is provided for use on rolls, for example in rolling stands, in particular on a working and/or supporting roll of a rolling stand for hot rolling aluminum. However, the device according to the invention can also be provided for use for rolls in a strip guidance system. To this end, in FIG. 1 of the drawing, the device according to the invention for setting a rotating brush 1 is illustrated in its zero position and, in FIG. 2, is illustrated in its effective position, located on the roll designated by 2. In these two figures, different working positions of this roll 2 are indicated schematically. The principal structural features of a rolling stand are in this case known to the appropriate person skilled in the art and are therefore not illustrated in detail in the drawing. The brushes are used for cleaning the rolls.

In the device according to the invention the preferably rotating brush 1 can be rotated toward the rolling rotation and mounted parallel to the roll 2 and can be displaced translationally. By the translational displacement, the rotating brush can be brought into contact with the rolls 2 via a setting device 3 exerting a setting force, see FIG. 1 or 2. According to the invention, provision is made in this case for this setting device 3 to comprise an adjusting element 5 that is arranged such that it can rotate in relation to a pivoting lever 12 with the brush 1, which is operatively connected to the pivoting lever via a force transmission element 4. A control loop 6 is provided, starting from an intended force Fo, for the constant regulation of the setting force in such a way that, via a monitoring device 7 for the angle of rotation of the adjusting element 5 in relation to the brush 1, the setting force can be regulated constantly via an actuating element 8. For this purpose, this control loop 6 for setting the rotating brush 1 is illustrated schematically in FIG. 3.

With these means, for the first time a device for setting a rotating brush device 1 is provided in which a constant setting force can be set irrespective of the roll diameters employed and their working positions and also independently of wear of the brushes, in the arrangement according to the invention only one parameter, specifically the angle of rotation, still needing to be monitored in order to keep the setting force constant. In this case, by rotating the adjusting element 5 in relation to the rotating brush 1, conclusions about the force on the brush are drawn via the angle of rotation. Parameters that change, for example during the rolling, such as roll wear (smaller diameter), brush wear or a changed position of the rolls, have no influence on the setting force, since these changes are compensated. This also applies to changing diameters or working positions in the event of a roll change. Overall, with the arrangement according to the invention, very simple and functionally suitable control of the setting force is achieved by using only a few additional components; in this case, in particular, no additional components such as additional pneumatics or hydraulic control are needed.

In the embodiment of the arrangement according to the invention that is illustrated in the figures, the force transmission element 4 between adjusting element 5 and rotating brush device 1 is formed as a compression spring 9. Via this compression spring 9, an angle of rotation of the adjusting element 5 in relation to the brush 1 or the pivoting lever can be converted into a change in the setting force with a linear dependence. In this case, again see FIG. 1 or 2, the adjusting element 5 which is arranged such that it can rotate in relation to the brush 1 is formed as an adjusting lever 11 mounted such that it can rotate about the pivot axis 10. The rotating brush 1 itself is mounted on a pivoting lever 12, whose diametrically opposite end is mounted in the pivot axis 10. Using a construction of this type, particularly simple registration of the angle of rotation is made possible.

The actuating element 8 for the constant regulation of the setting force in the exemplary embodiment illustrated, see FIGS. 1 and 2 of the drawing again, is formed as a hydraulic cylinder 13 acting on the adjusting lever 11 via a joint not designated here. Via this hydraulic cylinder 13 acting on the adjusting lever 11, constant regulation of the setting force is possible without difficulty. The monitoring device 7 for the angle of rotation is in this case formed as a rotary encoder 14; in this regard see firstly FIGS. 1 and 2 of the drawing. By using this rotary encoder 14, the force change is converted in a simple way into an angle change in order to determine the current actual value for the angle of rotation.

In the arrangement according to the invention, provision is additionally made for the predefinition for the intended force $F_0$ for the control loop 6 to be formed as a function of the brush type (e.g. type of brush hair) and of the roll width. Optionally, provision can also be made for the predefinition for the intended force $F_0$ for the control loop 6 to be formed as a function of the roll material and/or the material to be rolled (e.g. steel, copper or the like).

With the arrangement according to the invention, a constant setting force can be set irrespective of the roll diameters used and their working positions, and also irrespective of the wear of the brushes. To this end, see FIG. 3 of the drawing, which shows a schematic illustration of the control loop 6 of the device according to the invention, the predefined intended force $F_{predef}$ is converted into an intended angle $\alpha_{predef}$ for the angle of rotation in a conversion unit 15 and is fed to an intended-actual value comparator 16. By using this intended-actual value comparator 16, by means of a comparison with the current actual value $\alpha_{act}$, the control deviation e of the angle of rotation is then determined and is fed to a controller 17. Depending on the control deviation e, this controller 17 determines the actuating variable for the actuating element 8 formed as a hydraulic cylinder 13. The output variable from the actuating element 8 or the hydraulic cylinder 13 is then fed to the monitoring device 7 for the angle of rotation, formed as a rotary encoder 14, the monitoring device 7 finally changing the angle of rotation in such a way that the control deviation becomes zero as far as possible and the intended force is set. The current actual value $\alpha_{act}$ is then subsequently monitored further and fed back to the intended-actual value comparator 16 again and a new control deviation e is determined in order to repeat the procedure.

As already mentioned, the embodiments illustrated should be judged only as an example of the implementation of the invention; modifications are possible. For instance, in particular the adjusting element 5, the force transmission element 4 and the actuating element 8 can have a construction differing from the embodiments illustrated; also conceivable in particular is a different mounting for the rotating brush device 1.

LIST OF DESIGNATIONS

1 (Rotating) brush
2 (Working) roll
3 Setting device (for 1 on 2)
4 Force transmission element
5 Adjusting element
6 Control loop
7 Monitoring device
8 Actuating element
9 Compression spring
10 Pivot axis (of 1)
11 Adjusting lever
12 Pivoting lever
13 Hydraulic cylinder
14 Rotary encoder
15 Conversion unit $F_{predef}/\alpha_{predef}$
16 Intended-actual value comparator
17 Controller
e Control deviation

The invention claimed is:

1. A device for setting a brush (1) on to a roll (2) for shaping or guiding strip material, for example in rolling stands or strip guiding devices, comprising:

a pivoting lever (12), on whose one end the brush (1) is mounted such that it can rotate and is preferably parallel to the roll (2), and on whose other end the pivoting lever (12) is mounted such that it can rotate about a pivot axis (10); and a setting device (3) for setting the brush (1) against the roll (2) with a setting force, characterized in that the setting device (3) for the brush (1) comprises at least one adjusting element (5) that is arranged such that it can rotate in relation to the pivoting lever (12), and a force transmission element (4) for forming an operative connection between the pivoting lever (12) and the adjusting element (5);

a monitoring device (7) is provided to monitor the angel of rotation of the adjusting element (5) in relation to the pivoting lever (12); and a control loop (6) is provided in order to keep the setting force of the brush (1) against the roll (2) constant to a predefined intended force $F_0$ by readjusting and keeping constant the angle of rotation monitored by the monitoring device (7), via at least one actuating element (8).

2. The device as claimed in claim 1, characterized in that the force transmission element (4) between the adjusting element (5) and the pivoting lever (12) is formed as a compression spring (9).

3. The device as claimed in claim 1, characterized in that the adjusting element (5), which is arranged such that it can rotate in relation to the brush (1), is constructed as an adjusting lever (11).

4. The device as claimed in claim 1, characterized in that the adjusting element (5) is mounted such that it can rotate about the pivot axis (10).

5. The device as claimed in claim 1, characterized in that the actuating element (8) for the constant regulation of the setting force is formed as a hydraulic cylinder (13).

6. The device as claimed in claim 5, characterized in that the actuating element (8) for the constant regulation of the setting force is formed as a hydraulic cylinder (13) acting on the adjusting lever (11).

7. The device as claimed in claim 1, characterized in that the monitoring device (7) for the angle of rotation is formed as a rotary encoder (14).

8. The device as claimed in claim 1, characterized in that the predefinition for the intended force $F_0$ for the control loop (6) is formed as a function of the brush type.

9. The device as claimed in claim 1, characterized in that the predefinition for the intended force $F_0$ for the control loop (6) is formed as a function of the roll width.

10. The device as claimed in claim 1, characterized in that the predefinition for the intended force $F_0$ for the control loop (6) is formed as a function of the roll material.

11. The device as claimed in claim 1, characterized in that the predefinition for the intended force $F_0$ for the control loop (6) is formed as a function of the strip material.

12. The device as claimed in claim 1, characterized in that the roll (2) and/or the brush (1) is designed to rotate.

* * * * *